US008465269B2

(12) United States Patent
Cacard et al.

(10) Patent No.: US 8,465,269 B2
(45) Date of Patent: Jun. 18, 2013

(54) DRY VACUUM PUMP INCLUDING A LUBRICATING FLUID SEALING DEVICE AND A CENTRIFUGE ELEMENT EQUIPPING SUCH A DEVICE

(75) Inventors: Albert Cacard, Groisy (FR); Francois Houze, Annecy (FR)

(73) Assignee: Alcatel Lucent, Paris (IT)

( * ) Notice: Subject to any disclaimer, the term of this patent is extended or adjusted under 35 U.S.C. 154(b) by 582 days.

(21) Appl. No.: 12/452,978

(22) PCT Filed: Jun. 16, 2008

(86) PCT No.: PCT/EP2008/057574

§ 371 (c)(1), (2), (4) Date: Mar. 15, 2010

(87) PCT Pub. No.: WO2009/024370

PCT Pub. Date: Feb. 26, 2009

(65) Prior Publication Data

US 2010/0189583 A1 Jul. 29, 2010

(30) Foreign Application Priority Data

Aug. 23, 2007 (FR) ..... 07 57146

(51) Int. Cl.

| | |
|---|---|
| ***F01C 1/08*** | (2006.01) |
| ***F01C 1/24*** | (2006.01) |
| ***F04C 2/00*** | (2006.01) |
| ***F04C 18/00*** | (2006.01) |
| ***F16C 33/80*** | (2006.01) |

(52) U.S. Cl.

USPC ..... 418/194; 418/178; 418/179; 384/480

(58) Field of Classification Search

USPC ..... 418/83, 87, 95, 140–142; 277/412, 277/419, 429–431, 427; 384/477, 480

See application file for complete search history.

(56) References Cited

U.S. PATENT DOCUMENTS

| | | | | |
|---|---|---|---|---|
| 3,601,307 | A * | 8/1971 | Shapiro | 494/15 |
| 3,898,015 | A * | 8/1975 | Navelsaker | 415/111 |
| 4,386,786 | A * | 6/1983 | Agrama | 277/411 |
| 4,471,964 | A * | 9/1984 | Kotzur | 277/347 |
| 5,064,452 | A * | 11/1991 | Yano et al. | 96/214 |
| 6,325,382 | B1 * | 12/2001 | Iwamoto et al. | 277/368 |
| 6,866,270 | B2 * | 3/2005 | Keller et al. | 277/349 |

(Continued)

FOREIGN PATENT DOCUMENTS

| | | |
|---|---|---|
| DE | 27 00 226 | 7/1978 |
| DE | 20 2004 019718 | 3/2005 |

(Continued)

*Primary Examiner* — Thomas Denion
*Assistant Examiner* — Steven D. Shipe
(74) *Attorney, Agent, or Firm* — Carmen Patti Law Group, LLC

(57) ABSTRACT

The invention pertains to a dry vacuum pump comprising at least one rotating shaft (11) mounted on at least one lubricated bearing (5) and at least one sealing device (9) for sealing off lubricating fluids capable of entering the shaft passage from said bearing (5), said sealing device (9) being installed between the lubricated bearing (5) and a dry pumping stage (7), characterized in that said sealing device (9) comprises a centrifuge element (17) designed to rotate in unison on said shaft (11) and comprising at least one through line (19) capable of separating the lubricating fluids from the fluid that may travel from said bearing (5) to the dry pumping stage (7).

17 Claims, 3 Drawing Sheets

U.S. PATENT DOCUMENTS

Figure 1:
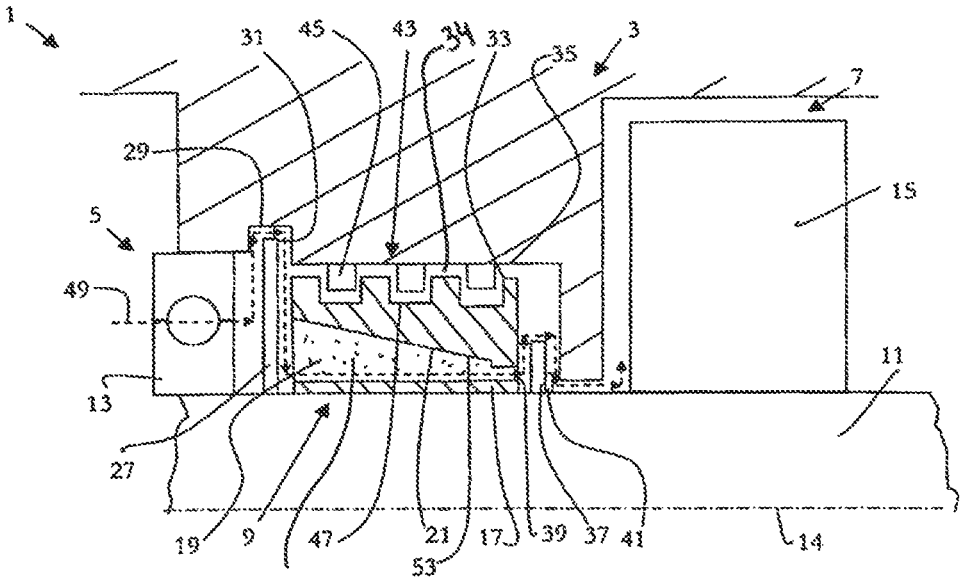

| | | | | |
|---|---|---|---|---|
| 2004/0119238 | A1* | 6/2004 | Skumawitz et al. | 277/412 |
| 2008/0246224 | A1* | 10/2008 | Pabst et al. | 277/412 |
| 2009/0140495 | A1* | 6/2009 | Dreifert et al. | 277/431 |
| 2009/0189356 | A1* | 7/2009 | Gaebler et al. | 277/431 |
| 2012/0000308 | A1* | 1/2012 | Schutterle et al. | 74/467 |

FOREIGN PATENT DOCUMENTS

| | | | |
|---|---|---|---|
| FR | 2 320 458 | | 3/1977 |
| JP | 61 291795 | | 12/1986 |
| WO | WO 2006106069 | A1 * | 10/2006 |

* cited by examiner

DRY VACUUM PUMP INCLUDING A LUBRICATING FLUID SEALING DEVICE AND A CENTRIFUGE ELEMENT EQUIPPING SUCH A DEVICE

This invention pertains to a dry vacuum pump such as a rotating-lobe vacuum pump, particularly of the multi-stage type, such as a Roots or Claw vacuum pump or such as a Scroll vacuum pump or such as a screw vacuum pump.

Generally, these pumps include one or more stages placed in series, in which a gas to be pumped travels between a gas intake and a gas exhaust.

Among known vacuum pumps, a distinction is made between those with rotating lobes, also known as "Roots" pumps with two or three lobes (bi-lobe, tri-lobe) or those with two tongues, also known as "Claw" pumps.

These pumps are, for example, described in the documents U.S. Pat. No. 6,572,351, U.S. Pat. No. 5,234,323, EP 0,365 695, U.S. Pat. No. 4,789,314 and EP 1,227,246.

Generally speaking, Roots rotating-lobe pumps comprise two rotors with identical cross-sections, turning within a stator (the body of the pump) in opposite directions. When they rotate, the sucked-in gas is trapped inside the open space found between the rotors and the stator, and then escapes through the exhaust. The pump operates without any mechanical contact between the rotors and the body of the pump, which makes it possible for oil to be completely absent from the compression chamber.

The two-tongue "Claw" pumps also comprise two lobed rotors turning in opposite directions within a cylinder, sucking in gas and compressing it. However, the lobes are specially shaped to ensure dry compression.

The rotors are carried by rotating shafts supported by at least one lubricated bearing, which may be lubricated by oil or grease, for example.

When operating, the rotation of the shafts within the bearings generates pollutants such as grease particles or clumps of oil, which, when they are subjected to variations in pressure, may migrate towards the pumping stages.

Thus, it is essential that no traces of oil or grease remain in the pumping stages for so-called "dry" applications, such as processes for manufacturing semi-conductor substrates.

It is therefore suitable to isolate the lubricated bearings from the dry pumping stages using a sealing device through which the shaft is still capable of rotating.

To remedy this, so-called "lip" seal rings are already known.

However, the rubbing of the joints against the rotating shaft causes them to become worn, and quickly leads to a loss of the sealing properties, requiring frequent maintenance for the vacuum pump, which each maintenance call requiring the semi-conductor manufacturing installations and the vacuum pump to be shut down, which is very costly.

Furthermore, the pressure within the pumping stages frequently varies between high and low pressures, causing significant differences in pressure between the bearings and the pumping stages.

These repeated discrepancies in pressure on either end of the joints also cause them to suffer premature wear.

Other techniques are also known, which use dynamic contact-free joints, allowing pressures to be kept in balance on either side of the sealing area between the bearing and the dry pumping stage.

These contact-free dynamic joints use gas turbulence as a means of sealing. However, these devices do not make it possible for oil or grease mists and vapors to migrate towards the pumping areas.

The purpose of this invention is therefore to propose a dry vacuum pump whose sealing device requires little or no maintenance tasks on the pump, while ensuring that the pumping stages are free from oil or grease, and more particularly, free from the mists or vapors of these lubricants.

To that end, the invention discloses a dry vacuum pump comprising at least one rotating shaft mounted on at least one lubricated bearing and at least one sealing device for sealing off lubricating fluids capable of entering the shaft passage from said bearing, said sealing device being installed between the lubricated bearing and one dry pumping stage, characterized in that said sealing device includes a centrifuge element installed so as to rotate in unison said shaft and including at least one through line capable of separating the lubricating fluids from the gas that may travel from said bearing to the dry pumping stage.

Preferentially, the centrifuge element further comprises a filtering body placed within the through line, such as a fibrous material.

Preferentially, the through line is located closer to the shaft than to the circumferential surface of the centrifuge element.

The diameter of the orifice of the through line is designed to be larger on the bearing end than on the dry pumping stage end.

For example the through line is designed to be shaped like the barrel of a cone, whose point is located beside the dry pumping stage end.

Alternatively, one part of the through line may be designed to have a bottleneck, or the through line may be formed by a recess in the centrifuge element shaped like the barrel of a cone, whose axis of revolution is the same as the rotational axis of the centrifuge element, and whose point empties into a predefined number of orifices on the pumping stage end.

Additionally, the conductance of the through line is designed to be greater than the conductance of the peripheral fluid passage formed between the circumferential surface of the centrifuge element and the inner wall of the stator.

Preferentially, the sealing device includes a check valve placed facing the through line orifice located on the pumping stage end.

The check valve is preferentially made up of a disk installed so as to slide along the rotating shaft.

For example, the peripheral passage may be designed to include a labyrinth seal.

The labyrinth seal may include multiple rings installed within the stator and the circumferential surface of the centrifuge element may possess several corresponding pits.

Advantageously, each ring is open and elastic so that it can be installed in the stator.

Preferentially, the outer diameter of each ring when at rest is greater than the diameter of the inner wall of the stator, so that after the rings are inserted into the stator, they are held against the inner wall of the stator by the elastic force of the ring.

The sealing device may also be designed to include a deflector installed on the shaft between the bearing and the centrifuge element.

The invention also discloses a lubricated fluid sealing device centrifuge element intended to be installed so as to rotate in unison upon a rotating shaft of a dry vacuum pump, between a lubricated bearing and a dry pumping stage, characterized in that it comprises at least one through line through which a mixture of lubricating fluid and gas may travel from the bearing to the dry pumping stage to separate the lubricating fluids from the gas.

Figure 2:
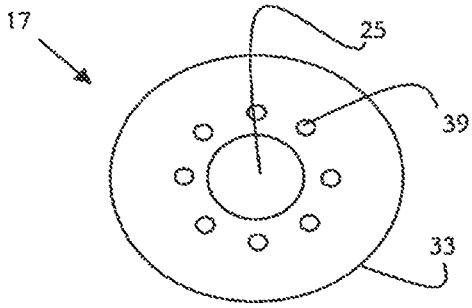
Figure 3:
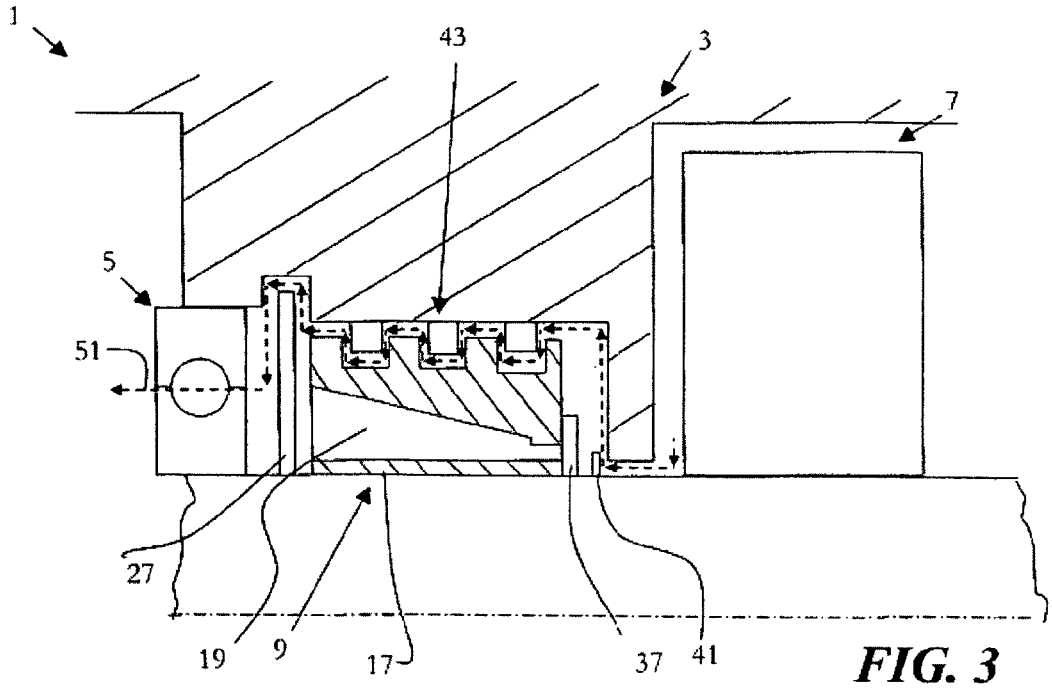

Other advantages and characteristics shall become apparent upon reading the description of the invention, as well as the attached drawings, in which:

FIG. 1 is a longitudinal section view of a part of the vacuum pump of the invention, FIG. 2 is a schematic front view of an example embodiment of the centrifuge element of the invention, FIG. 3 is a longitudinal section view of a part of the vacuum pump of FIG. 1, FIGS. 4, 5, and 6 are longitudinal section views of variant embodiments of the vacuum pump of FIG. 1.

In these figures, identical elements are given the same reference numbers.

The invention applies to a dry vacuum pump including at least one rotating shaft supported by at least one lubricated bearing and at least one sealing device for sealing off lubricating fluids capable of entering the shaft passage from the bearing, said sealing device being installed between the lubricated bearing and a dry pumping stage.

Advantageously, one sealing device is disposed for each pumping stage adjacent to a bearing in the vacuum pump.

In a vacuum pump, such a vacuum pump including two rotating lobed shafts, particularly of the multi-stage type, such as Roots or Claw pumps or a pump based on a similar principle, four sealing devices are therefore disposed at the four bearings of the pump.

Naturally, the invention also applies to any type of dry vacuum pump, such as scroll vacuum pumps or screw vacuum pumps.

FIG. 1 represents a part of the vacuum pump 1 according to a first embodiment of the invention.

The interior of the stator 3 of the vacuum pump 1 includes a bearing 5, a pumping stage 7, and a lubricated fluid sealing device 9 for the passage of a rotating shaft 11, installed between the bearing 5 and the pumping stage 7.

The bearing 5 comprises a roller bearing 13 lubricated by a fluid, such as grease or oil. For this purpose, the bearing 5 is advantageously join with an oil pan (not depicted) that distributes oil evenly to the gears of the shafts.

Further downstream within the pump 1, the shaft 11 capable of turning around the rotational axis 14 extends into the pumping stage 7, where it bears a rotor 15 such as one with rotating lobes.

The pumping stage 7 is said to be "dry", because when it is operating, the rotors 15 turn within the stator 3 in opposite directions without any mechanical contact between the rotors 15 and the body 3 of the pump 1, which makes it possible for oil to be completely absent.

The sealing device 9 makes it possible to heavily limit the passage of lubricating fluids such as grease or oil from the bearing 5 to the dry pumping stages 7, while enabling the shaft 11 to turn when the vacuum pump 1 is operating.

In the invention, the sealing device 9 comprises a centrifuge element 17 installed so as to rotate in unison on the shaft 11, and comprising at least one through line 19 capable of separating the lubricating fluids from the gas that may travel from the bearing to the dry pumping stage 7.

The fluid that may travel from the bearing to the dry pumping stage comprises a mixture of lubricating fluid and gas.

In this manner, when the vacuum pump 1 is operating, the centrifuge element 17 will rotate at the same rotational velocity as the shaft 11, for example, at 6000 revolutions per minute for a primary Roots vacuum pump.

Consequently, the through line 19 borne by the centrifuge element 17 will also rotate around the rotational axis 14 of the shaft 11 of the pump 1, and do so at the same rotational velocity.

As the lubricating fluid in the form of a mist, liquid, or residual particles has a mass or density greater than the gas, circulating within the through line 19, will be kept away from the center 14 of the centrifuge element 17.

In fact, the centrifugal force created by the rapid rotation of the centrifuge element 17 projects the lubricating fluids onto the inner side surfaces 21 of the line 19, thereby separating the lubricating fluid from the gas by centrifuging.

More specifically, the sealing device separates the mists and/or the vapors of the lubricant from the gas.

Advantageously, the diameter of the orifice 39 of the through line 19 is greater on the bearing 5 end than on the dry pumping stage 7 end.

For example, in FIG. 1, one part of the through line 19 has a bottleneck 53 formed by a recess in the centrifuge element 17 shaped like the barrel of a cone whose axis of revolution is the same as the rotational axis 14 of the centrifuge element 17 and whose point communicates with a predefined number of orifices 39 on the pumping stage 7 end.

The cone barrel shape will, in particular, make it possible, by centrifugal force, to guide the vapors and mists of lubricants trapped along the walls, in order to discharge them through the line 19.

The lubricant fluid is thereby guided towards the base of the centrifuge element 17, enabling the sealing device to be self-cleaning.

Other embodiments of the through line 19 shall be described later on.

Furthermore, multiple through lines 19 are provided for, in such a way as to optimize the flow of the gas.

Thus, FIG. 2 represents a centrifuge element 17 possessing eight orifices 39 of through lines 19 as well as an opening 25 in the center of the centrifuge element 17 for the passage of the shaft 11.

To further improve the ability of the device 9 to seal off lubricating fluids, the centrifuge element 17 may advantageously be designed to include a filtering body 26 placed within the through line 19, such as a fibrous material (FIG. 1).

The fibrous material may, for example, be steel-wool-based or glass-wool-based.

In this manner, whenever a mixture of lubricating fluid and gas travels within the line 19, the lubricant residue is trapped within the fibers of the filtering body 26.

Next, by centrifugal force, the oil vapors and/or mists trapped within the filtering body will also be projected towards the walls of the centrifuge element 17, and then guided towards the base of the centrifuge element 17.

In this manner, as with the through line 19, the filtering body cleans itself.

Furthermore, the sealing device may advantageously be designed to include a deflector 27 installed on the shaft 11 between the bearing 5 and the centrifuge element 17.

The deflector 27 makes it possible to modify the flow of the mixture of lubricating fluid and gas arriving from the bearing 5 to form a first means of rough separation of lubricants in liquid, grease, and particle form arriving from bearing 5.

A corresponding groove 29 is provided for within the stator 3, located across from the peripheral edge 31 of the deflector 27.

In this manner, whenever the mixture of lubricating fluid and gas travels from the fluid 5 to the pumping stage 7, the large particles and the liquids are deflected by the deflector 27 into the groove 29, forming a first rough filtering of the gas.

Preferentially, a canal (not depicted) extends from the groove 29 into the stator 3 of the pump 1.

This canal may join with the oil pan of the lubricated bearings. The lubricant travelling within the groove 29 is then led into the canal, then towards the oil pan.

Advantageously, the through line 19 is located closer to the shaft 11 than the circumferential surface 33 of the centrifuge element 17, as depicted in FIG. 2.

This placement just against the rotational axis 14 of the shaft 11 enables the device 9 to benefit from the centrifugal effect, and a complementary rolling effect, as much as possible.

The complementary rolling effect is produced by localized higher pressure between the deflector 27 and the centrifuge element 17. It is the result of the low space between the deflector 27 and the centrifuge element 17.

The rolling effect also makes it possible to disperse the lubricants to the periphery of the deflector 27.

In one very advantageous aspect of the invention, the conductance of the through line 19 is greater than the conductance of the peripheral fluid passage 34 formed between the circumferential surface 33 of the centrifuge element 17 and the inner wall 35 of the stator 3.

With this design, the mixture of lubricating fluid and gas preferably flows through the through line 19 of the centrifuge element 17 instead of around its periphery, whenever the pressure at the bearing 5 end is higher.

In this manner, the mixture of lubricating fluid and gas is filtered well by the centrifuge element 17 and the pressure differential on either side of the centrifuge element 17 is limited, as flow through the peripheral passage 34 is greatly reduced due to the high conductance.

For the opposite situation, i.e. whenever the pressure is higher on the pumping stage end, the sealing device 9 includes a check valve 37 facing the orifice 39 of the through line 19, located at the pumping stage 7 end.

The position of the valve 37 makes it possible to oriented the preferred pathway of the mixture of lubricating fluid and gas depending on the pressure differential.

When it is kept away from the orifice 39, the mixture of lubricating fluid and gas preferably flows through the through line 19, as the through line 19 has the greater conductance.

When it is held against the orifice 39, the mixture of lubricating fluid and gas preferably flows through the peripheral passage 34 of the centrifuge element 17.

The opening and closing of the line 19 by the valve 37 is controlled naturally by the difference in pressure on either side of it.

This valve 37 is placed on the shaft 11 in such a way as to be in a position distant from the orifice 39 when the pressure on the bearing 5 end is greater than the pressure in the pumping stage 7.

By this innovative means, the sealing device 9 is optimized, as the turbulent movements of the gas and lubricants within the through line 19 are avoided, as the flow through the through line 19 only travels in one direction.

The pressure on either side of the sealing device 9 may therefore strike a balance automatically through two distinct passages, depending on whether or not the mixture of lubricating fluid and gas is charged with lubricants.

The check valve 37 may be designed in the form of a simple disk installed to slide axially along the shaft 11, such as a metal disk, with the path of the check valve being defined by the centrifuge element 17 and a stop 41 attached to the shaft 11.

The radius of the valve 37 is designed to be sufficiently large to be capable of blocking the orifices 39 of the through lines 19 that empty out on the pumping stage 7 end.

In this manner, the valve 37 is pushed by the flow of the mixture of lubricating fluid and gas towards the pumping stage 7, and is held by the stop 41 (see FIG. 1) when the pressure at the bearing 5 is greater than the pressure at the pumping stage 7, thereby allowing the mixture of lubricating fluid and gas to pass through the through line 19 of the centrifuge element 17.

Conversely, the valve 37 is pulled towards the centrifuge element 17 by the flow of the mixture of lubricating fluid and gas when the pressure at the bearing 5 is less than the pressure at the pumping stage 7, preventing the mixture of lubricating fluid and gas from passing through the through line 19.

In this manner, a balance is struck between the pressures on either side of the sealing device 9, and additionally, the circulation of the clean gas within the peripheral passage 34 makes it possible to guide the lubricant residue that could have become trapped there.

In fact, the low conductance of the peripheral passage 34 of the gases accelerates them, leading the residue towards the groove 29 of the stator 3.

Preferentially, the peripheral fluid passage 34 is formed by a labyrinth seal 43.

The labyrinth seal includes a succession of baffles limiting the conductance of the passage between the stator 3 and the centrifuge element 17.

Conventionally, the baffles are formed by grooves and corresponding pits respectively borne by the stator and the rotating element, and centered facing them without touching them to avoid significant friction when the rotating element is at high rotational velocities.

In the invention, the peripheral passage 34 is thereby constructed between the circumferential surface 33 of the centrifuge element 17 and the stator 3 of the pump 1, which makes it possible to avoid friction when the centrifuge element 17 is at high rotational velocities.

However, conventional labyrinth seals have the drawback of being difficult to assemble.

In fact, to assemble these seals, it is necessary to design a two-part stator, which is assembled and centered around the rotor carrying the corresponding pits.

To remedy this drawback, the invention advantageously provides for a labyrinth seal 43 independent from the line 19, characterized in that it comprises multiple rings 45 installed within the stator 3 and in that the circumferential surface 33 of the centrifuge element 17 has multiple corresponding pits 47.

The rings 45 are elements distinct from the stator 3, and are designed to be open and elastic, so that they can be installed within the stator 3.

This configuration makes assembly easier.

In fact, the outer diameter of each ring 45 when at rest is greater than the diameter of the inner wall 35 of the stator 3, so that after the rings 45 are inserted within the stator 3, they are held against the inner wall 35 of the stator 3 by the elastic force of the ring 45.

At the time of assembly, and firstly, the open rings 45 are slide into the pits 47 of the centrifuge element 17.

Secondly, an auxiliary mounting tube is disposed around the centrifuge element 17 bearing the rings 45, so that the rings 45 are compressed, with the ends of each ring 45 touching one another.

Next, the tube comprising the rings 45 and the centrifuge element 17 is slid into the stator 3.

Finally, the tube is removed, allowing the freed rings 45 to decompress within the stator 3.

The elasticity of the rings 45 is selected in such a way so that they stay solidly fastened to the stator 3.

In this manner, a labyrinth seal 43 is obtained between the stator 3 and the centrifuge element 17, whose pits 47 and grooves 45 are easy to manufacture, center, and assemble.

Naturally, this type of labyrinth seal 43 applies just as well to the centrifuge element 17 of the invention as to any rotating element turning within a stator, such as a rotor or a rotating shaft.

During the operation of the vacuum pump as previously described, when the pressure at the bearing 5 is greater than the pressure at the pumping stage 7, the mixture of lubricating fluid and gas takes the pathway depicted by the arrow 49 in FIG. 1.

Firstly, the flow of the mixture of lubricating fluid and gas arriving from the bearing 4 is deflected by the deflector 27, roughly separating the lubricating liquids and particles.

Simultaneously, the valve 37 is pushed towards the pumping stage 7, thereby freeing up access to the through line 19, in such a way that a majority of the mixture of lubricating fluid and gas travels through the centrifuge element 17.

The gas is thereby separated from the lubricating fluids by centrifuging.

These lubricating fluids are then expelled from the through line 19 by centrifugal force.

Next, if the pressure at the bearing becomes less than the pressure at the pumping stage 7, the mixture of lubricating fluid and gas takes the peripheral passage 34 whose path is depicted by the arrows 51 of FIG. 3.

The valve 37 is pulled towards the centrifuge element 17, preventing the mixture of lubricating fluid and gas from passing through the through line 19, in such a way so that the majority of the mixture of lubricating fluid and gas travels through the peripheral passage 34, guiding the lubrication residue.

As mentioned above, other embodiments of the through line 19 may be foreseen.

For example, the bottleneck 53 of the through line 19 may be formed by a choke in the line 19 (not depicted).

Figure 4:
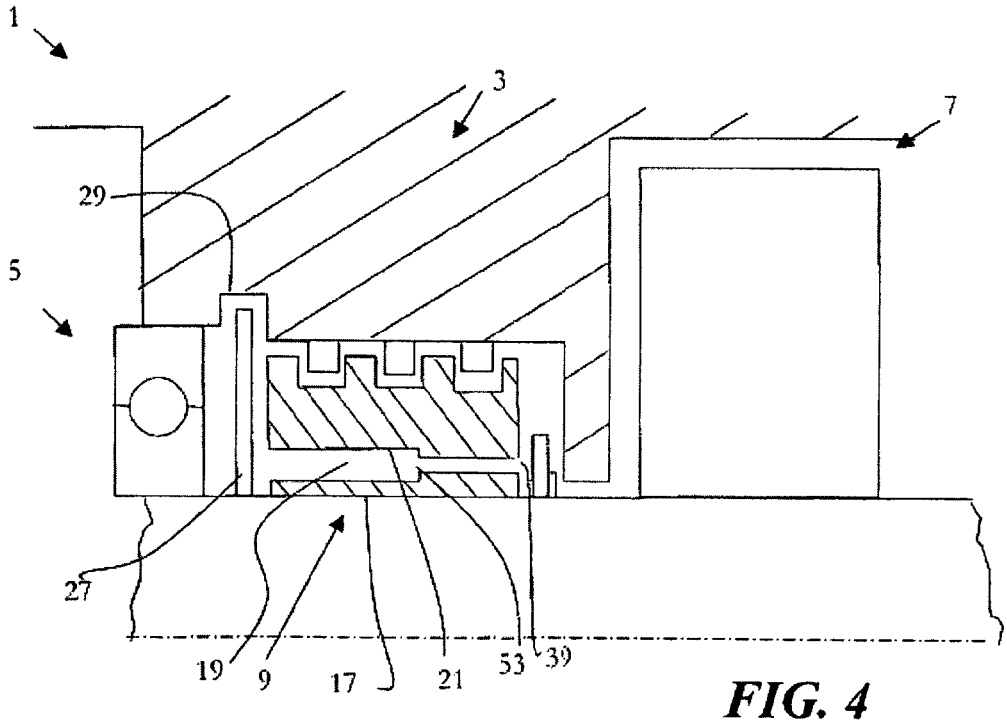
Figure 5:
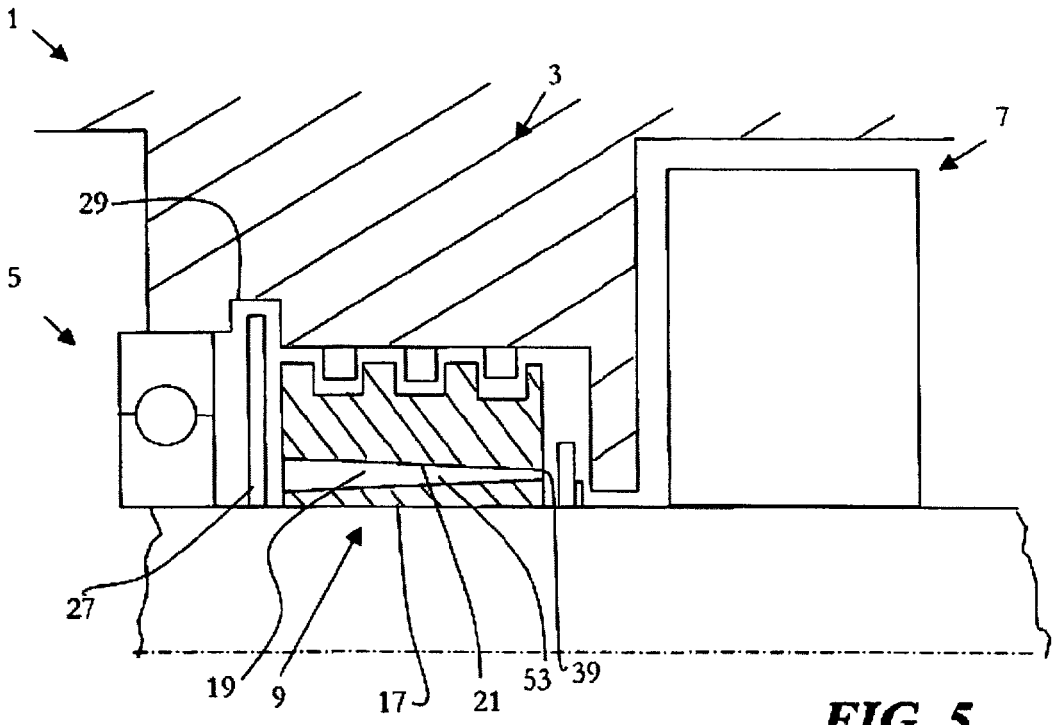

FIGS. 4 and 5 depict other advantageous embodiments of the invention, in which the diameter of the orifice 39 of the through line 19 is greater on the bearing 5 end than on the dry pumping stage 7 end.

In FIG. 4, the through line 19 has a cross-section that bottlenecks by forming a step whose diameter portion reduces the mouth leading to the dry pumping stage 7.

This variant has the advantage of being very simple to construct.

In fact, such a line 19 may be obtained, for example, by drilling using a step drill.

Alternatively, as depicted in FIG. 5, the through line 19 is shaped like the barrel of a cone, whose point is located at the dry pumping stage 7.

The partial or continuous bottleneck 53 of the through line 19 makes it possible to slow down the lubricant residue projected onto the inner side surfaces 21 of the line 19.

This residue will then travel along the inner surface 21 of the line 19 until returning to the bearing 5.

When this residue reaches the deflector 27, they are led into the groove 29 of the stator 3 and guided to the canal leading to the oil pan.

Figure 6:
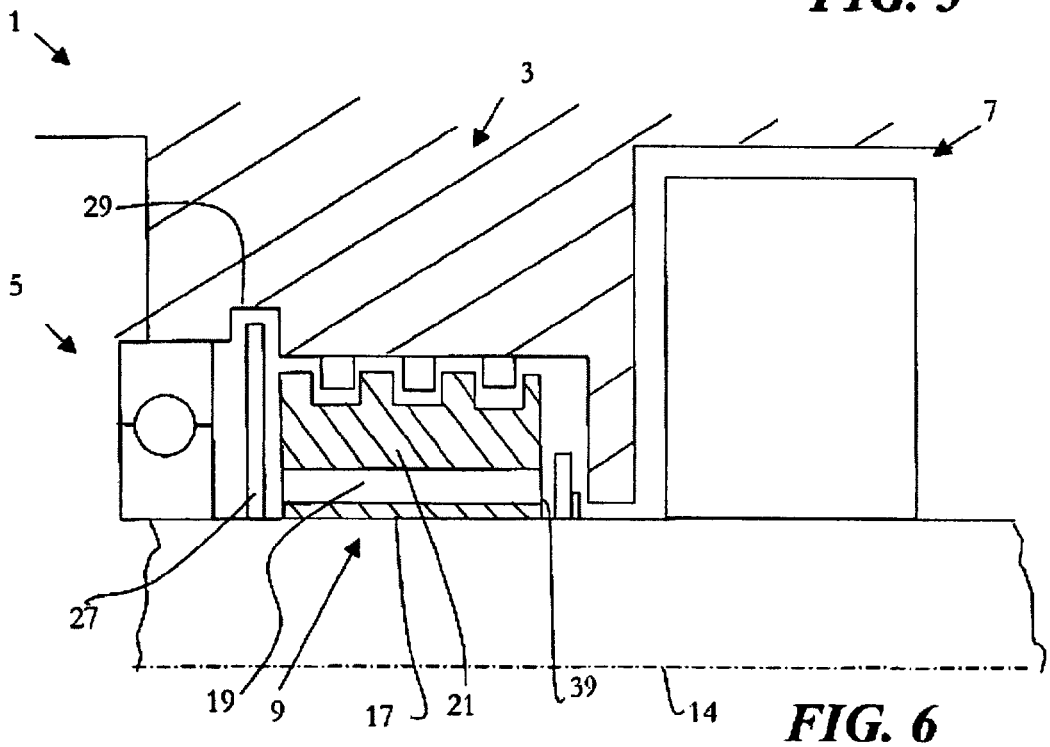

In another variant, the through line 19 is tube-shaped (FIG. 6).

In this manner, it is understood that a vacuum pump 1 comprising at least one lubricating fluid sealing device 9 including a centrifuge element 17 installed so as to rotate in unison on the shaft 11 and comprising at least one through line 19, makes it possible to ensure that the lubricants are sealed off without any rubbing parts and therefore without wear, requiring little maintenance.

The invention claimed is:

1. A dry vacuum pump comprising at least one rotating shaft mounted on at least one lubricated bearing and at least one sealing device for sealing off lubricating fluids capable of entering the shaft passage from said bearing, said sealing device being installed between the lubricated bearing and one dry pumping stage; said sealing device including a centrifuge element installed so as to rotate in unison upon said shaft; said centrifuge element including at least one through line configured to separate the lubricating fluids from a mixture of lubricating fluids and gas that may travel from said bearing to the dry pumping stage.

2. A vacuum pump according to claim 1, wherein the centrifuge element further comprises a filtering body placed within the through line.

3. A vacuum pump according to claim 2, wherein the filtering body is a fibrous material.

4. A vacuum pump according to claim 1, wherein the through line is located closer to the rotating shaft than a circumferential surface of the centrifuge element, wherein a distance between the through line and the shaft is smaller than a distance between the through line and the circumferential surface.

5. A vacuum pump according to claim 1, wherein one part of the through line has a bottleneck.

6. A vacuum pump according to claim 5, wherein the diameter of the orifice of the through line is larger on a bearing end than on a dry pumping stage end.

7. A vacuum pump according to claim 6, wherein the through line is shaped like the barrel of a cone whose point is located at the dry pumping stage end.

8. A vacuum pump according to claim 6, wherein the through line is formed by a recess in the centrifuge element shaped like the barrel of a cone whose axis of revolution is the same as the rotational axis of the centrifuge element and whose point feeds into a predefined number of orifices at the pumping stage end.

9. A vacuum pump according to claim 1, wherein the conductance of the through line is greater than the conductance of a peripheral fluid passage formed between the circumferential surface of the centrifuge element and an inner wall of a stator.

10. A vacuum pump according to claim 9, wherein the sealing device includes a check valve placed facing a through line orifice located on a pumping stage end, wherein the check valve prevents flow in the direction of the bearing.

11. A vacuum pump according to claim 10, wherein the check valve is formed by a disk installed so as to slide along the rotating shaft.

12. A vacuum pump according to claim 9, wherein the peripheral passage comprises a labyrinth seal.

13. A vacuum pump according to claim 12, wherein the labyrinth seal comprises multiple rings installed within the stator and wherein the circumferential surface of the centrifuge element possesses several corresponding pits.

14. A vacuum pump according to claim 13, wherein each ring is open and elastic, so that it may be installed within the stator.

15. A vacuum pump according to claim 14, wherein an outer diameter of each ring when at rest is greater than the diameter of the inner wall of the stator, so that after the rings are inserted into the stator, they are held against the inner wall of the stator by the elastic force of the ring.

16. A vacuum pump according to claim 1, wherein the sealing device further comprises a deflector installed on the rotating shaft between said bearing and the centrifuge element.

17. A lubricated fluid sealing device including a centrifuge element installed so as to rotate in unison upon a rotating shaft of a dry vacuum pump, said centrifuge element being between a lubricated bearing and a dry pumping stage, and comprising at least one through line through which a mixture of lubricating fluids and gas may travel from the bearing to the dry pumping stage and configured to separate the lubricating fluids from the gas.

* * * * *